US008202116B2

(12) United States Patent
Suzuki et al.

(10) Patent No.: US 8,202,116 B2
(45) Date of Patent: Jun. 19, 2012

(54) CONNECTOR FOR BEING CAPABLE OF USE FOR A PORTION TO CONNECT A POWER HARNESS, WHICH IS USED FOR LARGE POWER TRANSMISSION

(75) Inventors: Sachio Suzuki, Hitachi (JP); Hideaki Takehara, Hitachi (JP); Kunihiro Fukuda, Tsukuba (JP); Yuta Kataoka, Hitachi (JP); Shinya Hayashi, Hitachi (JP)

(73) Assignee: Hitachi Cable, Inc., Tokyo (JP)

( * ) Notice: Subject to any disclaimer, the term of this patent is extended or adjusted under 35 U.S.C. 154(b) by 0 days.

(21) Appl. No.: 13/008,486

(22) Filed: Jan. 18, 2011

(65) Prior Publication Data

US 2011/0189891 A1 Aug. 4, 2011

(30) Foreign Application Priority Data

Feb. 1, 2010 (JP) ..... 2010-020688

(51) Int. Cl.
*H01R 13/648* (2006.01)

(52) U.S. Cl. ..... 439/607.01

(58) Field of Classification Search ..... 439/607.01, 439/157–159

See application file for complete search history.

(56) References Cited

U.S. PATENT DOCUMENTS 3,504,100 A * 3/1970 Ohshima et al. ..... 174/88 B
5,123,853 A * 6/1992 Gilbert et al. ..... 439/98
5,178,553 A * 1/1993 Hatagishi et al. ..... 439/157
5,222,909 A * 6/1993 Nomura et al. ..... 439/607.01
5,259,773 A * 11/1993 Champion et al. ..... 439/108
5,277,624 A * 1/1994 Champion et al. ..... 439/607.13
5,282,757 A * 2/1994 Maeda ..... 439/374
5,356,301 A * 10/1994 Champion et al. ..... 439/108
5,404,276 A * 4/1995 Hansson et al. ..... 361/821
5,484,297 A * 1/1996 Takahashi et al. ..... 439/157
5,622,524 A * 4/1997 Dirmeyer ..... 439/620.07
5,938,475 A * 8/1999 Penner et al. ..... 439/607.44
6,439,902 B1 * 8/2002 Cole et al. ..... 439/157
6,764,320 B1 * 7/2004 Lenoir et al. ..... 439/101
6,786,742 B2 * 9/2004 Matsuoka ..... 439/95
6,905,367 B2 * 6/2005 Crane et al. ..... 439/607.01
7,074,070 B1 * 7/2006 Huang et al. ..... 439/352
7,264,507 B2 * 9/2007 Beckman et al. ..... 439/607.37

(Continued)

FOREIGN PATENT DOCUMENTS

JP A-2004-056924 2/2004

(Continued)

*Primary Examiner* — Tulsidas C Patel
*Assistant Examiner* — Vladimir Imas
(74) *Attorney, Agent, or Firm* — Scully, Scott, Murphy & Presser, P.C.

(57) ABSTRACT

A connector includes a metallic male terminal housing with a plurality of first joining terminals aligned and accommodated therein, a female terminal housing with a plurality of second joining terminals aligned and accommodated therein, a stacked structure that when the male terminal housing is mated into the female terminal housing, within the male terminal housing, the plural first joining terminals an the plural second joining terminals face each other to form pairs, respectively, at one surface thereof, and the first joining terminals and the second joining terminals are disposed alternately, and an electricity screening plate disposed between the stacked structure and the male terminal housing to cover a side surface of the stacked structure facing the male terminal housing.

7 Claims, 6 Drawing Sheets

U.S. PATENT DOCUMENTS

| | | | | |
|---|---|---|---|---|
| 7,666,026 | B2 * | 2/2010 | Takehara | 439/489 |
| 7,666,027 | B2 * | 2/2010 | Takehara | 439/489 |
| 7,731,526 | B2 * | 6/2010 | Sato | 439/541.5 |
| 7,794,247 | B2 | 9/2010 | Suzuki | |
| 2002/0025704 | A1 * | 2/2002 | Takata | 439/157 |
| 2005/0090150 | A1 * | 4/2005 | Beckmann et al. | 439/607 |
| 2008/0176453 | A1 * | 7/2008 | Minich et al. | 439/660 |
| 2009/0075506 | A1 * | 3/2009 | Suzuki | 439/157 |
| 2009/0286418 | A1 * | 11/2009 | Takehara | 439/352 |
| 2009/0311899 | A1 * | 12/2009 | Takehara et al. | 439/292 |
| 2010/0120284 | A1 * | 5/2010 | Oka et al. | 439/372 |

FOREIGN PATENT DOCUMENTS

| | | |
|---|---|---|
| JP | A-2009-070754 | 4/2009 |

* cited by examiner

| |
|---|
| 1 CONNECTOR |
| 4a,4b,4c FIRST JOINING TERMINAL |
| 5 MALE TERMINAL HOUSING |
| 6a,6b,6c SECOND JOINING TERMINAL |
| 7 FEMALE TERMINAL HOUSING |
| 9 CONNECTING MEMBER |
| 45a FIRST ELECTRICITY SCREENING PLATE |
| 45b SECOND ELECTRICITY SCREENING PLATE |

1 CONNECTOR
4a,4b,4c FIRST JOINING TERMINAL
5 MALE TERMINAL HOUSING
6a,6b,6c SECOND JOINING TERMINAL
7 FEMALE TERMINAL HOUSING
9 CONNECTING MEMBER
45a FIRST ELECTRICITY SCREENING PLATE
45b SECOND ELECTRICITY SCREENING PLATE 4a,4b,4c FIRST JOINING TERMINAL
5 MALE TERMINAL HOUSING
8a,8b,8c,8d ISOLATING PLATE
9 CONNECTING MEMBER
10 FIRST INNER HOUSING
45a FIRST ELECTRICITY SCREENING PLATE

7 FEMALE TERMINAL HOUSING
6a,6b,6c SECOND JOINING TERMINAL
45b SECOND ELECTRICITY SCREENING PLATE

5 MALE TERMINAL HOUSING
7 FEMALE TERMINAL HOUSING
9 CONNECTING MEMBER
9a SHAFT
9b HEAD
45a FIRST ELECTRICITY SCREENING PLATE
45b SECOND ELECTRICITY SCREENING PLATE

CONNECTOR FOR BEING CAPABLE OF USE FOR A PORTION TO CONNECT A POWER HARNESS, WHICH IS USED FOR LARGE POWER TRANSMISSION

The present application is based on Japanese patent application No. 2010-020688 filed on Feb. 1, 2010, the entire contents of which are incorporated herein by reference.

BACKGROUND OF THE INVENTION

1. Field of the Invention

The present invention relates to a connector, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal (refer to JP-A-2009-070754, for example).

In recent years, such eco-friendly cars have been designed to reduce the weights of all parts thereof to enhance the energy saving performance of the cars. As one effective means to reduce the weights of parts of the cars, it has been proposed to reduce the sizes of the parts.

For example, a technique as described below, which has been disclosed by JP Patent No. 4037199, is known in the art.

JP Patent No. 4037199 discloses an electrical connection structure for a vehicle, which is for connecting multiphase conductive member joining terminals drawn out from a motor for driving the vehicle, and multiphase power line cable joining terminals drawn out from an inverter for driving the motor. The technique used in the electrical connection structure disclosed by JP Patent No. 4037199 is as follows: Each phase joining terminal of the conductive member and each corresponding phase joining terminal of the power line cable are overlapped, and isolating members are disposed on opposite surfaces to the overlapped surfaces of the joining terminals, respectively, and these overlapped joining terminals and isolating members are collectively fastened in an overlapping direction with a single bolt provided in a position to penetrate these overlapped joining terminals and isolating members.

That is, in the technique used in the electrical connection structure disclosed by JP Patent No. 4037199, the single bolt is tightened in the overlapping direction (stacking direction), to collectively hold the multiplicity of contacts between the joining terminals, which are the overlapped surfaces of the joining terminals, and thereby fix the joining terminals at the contacts therebetween, for electrical connections between the joining terminals, respectively. This configuration disclosed by JP Patent No. 4037199 is effective in easily ensuring size reduction, compared to the technique disclosed by JP-A-2009-070754.

Refer to JP-A-2009-070754 and JP Patent No. 4037199, for example.

SUMMARY OF THE INVENTION

Accordingly, the inventors have invented a novel stacked structure type connector that the electrical connection structure as in JP Patent No. 4037199 applies to the connector having the two terminal housings (male terminal housing and female terminal housing) to be mated together as in JP-A-2009-070754.

However, there is the problem that, when the terminal housings, which are typically metallic, are reduced in size, the distance between the terminal housings and the joining terminal contacts is short, i.e., the spatial distance is short, thereby leading to the occurrence of a short circuit between the terminal housings and the contacts. For that, it is necessary to solve the foregoing problem toward further reduction in connector size.

An object of the present invention is to provide a connector that has a stacked structure of a plurality of first joining terminals and a plurality of second joining terminals alternately arranged therein, allowing further size reduction to be ensured in comparison to the prior arts.

(1) According to one embodiment of the invention, a connector comprises:

a metallic male terminal housing with a plurality of first joining terminals aligned and accommodated therein;

a female terminal housing with a plurality of second joining terminals aligned and accommodated therein;

a stacked structure that when the male terminal housing is mated into the female terminal housing, within the male terminal housing, the plural first joining terminals and the plural second joining terminals face each other to form pairs, respectively, at one surface thereof, and the first joining terminals and the second joining terminals are disposed alternately; and an electricity screening plate disposed between the stacked structure and the male terminal housing to cover a side surface of the stacked structure facing the male terminal housing.

In the above embodiment (1) of the invention, the following modifications and changes can be made.

(i) The electricity screening plate is fixed integrally with and along an inner surface of the male terminal housing facing the stacked structure.

(ii) The connector further comprises a first inner housing for aligning and holding the plural first joining terminals, wherein the electricity screening plate is molded integrally with that first inner housing.

(iii) The electricity screening plate comprises a first electricity screening plate provided within the male terminal housing, and a second electricity screening plate provided within the female terminal housing, and the first electricity screening plate and the second electricity screening plate are overlapped at a specified wrap length, when the male terminal housing and the female terminal housing are mated with each other.

(iv) The connector further comprises:

a plurality of isolating members aligned and accommodated in the male terminal housing, the plural isolating members being fixed to other surfaces of the plural first joining terminals respectively; and a connecting member for pressing the adjacent isolating member, to thereby collectively fix the plural first joining terminals and the plural second joining terminals at the contacts therebetween, for electrical connections between the plural first joining terminals and the plural second joining terminals, respectively.

Points of the Invention

According to one embodiment of the invention, a connector is constructed such that an electricity screening plate is disposed between a stacked structure and a male terminal housing to cover the side surface of the stacked structure facing the male terminal housing. Thus, even when the clearance between each contact of the stacked structure and the male terminal housing is small, a stable insulation can be ensured and further size reduction can be achieved, compared to the prior arts.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment according to the invention, referring to the accompanying drawings.

Figure 1:
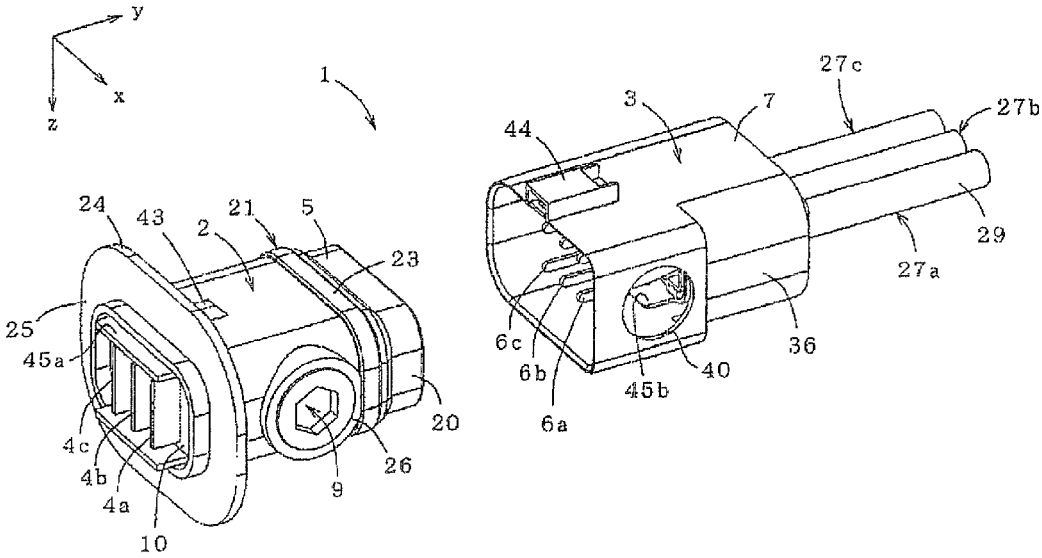
FIG. 1 is a perspective view showing a first connector portion and a second connector portion constituting a connector in one embodiment according to the invention.
Figure 2:
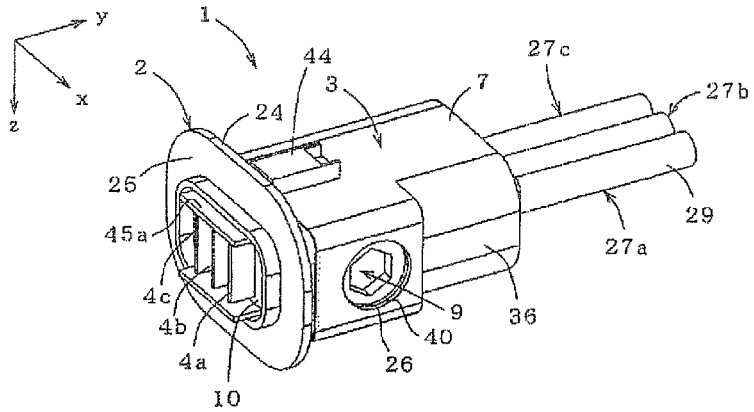
FIG. 2 is a perspective view showing the connector after mating the first connector portion and the second connector portion.
Figure 3:
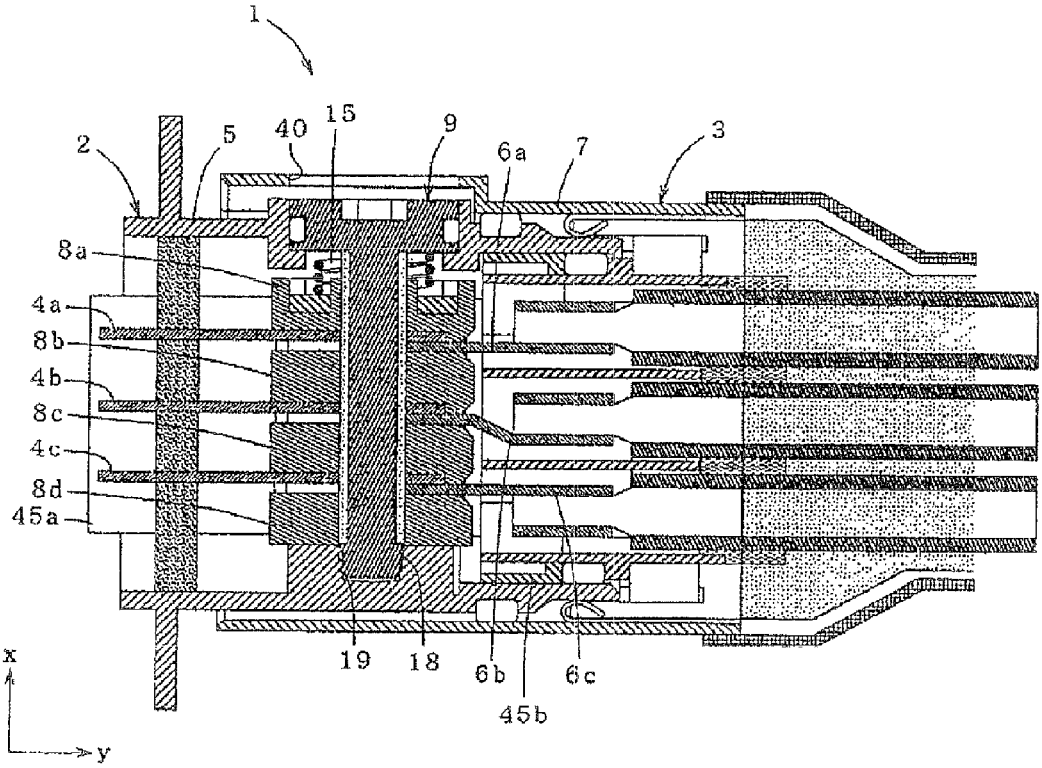
FIG. 3 is a cross-sectional view along an x-y plane showing the connector after mating the first connector portion and the second connector portion.

FIG. 1 is a perspective view showing a first connector portion and a second connector portion constituting a connector in one embodiment according to the invention, FIG. 2 is a perspective view showing the connector when mating the first connector portion and the second connector portion, and FIG. 3 is a cross-sectional view along an x-y plane thereof.

Connector 1 Structure

As shown in FIGS. 1 to 3, the connector 1 in this embodiment is constructed of a first connector portion 2 and a second connector portion 3, which are mated with each other, to thereby collectively connect a plurality of power lines.

More specifically, the connector 1 includes the first connector portion 2 having a male terminal housing 5 with a plurality of (three) first joining terminals (male terminals) 4*a* to 4*c* aligned and accommodated therein, the second connector portion 3 having a female terminal housing 7 with a plurality of (three) second joining terminals (female terminals) 6*a* to 6*c* aligned and accommodated therein, and a plurality of isolating members (isolating plates) 8*a* to 8*d* aligned and accommodated in the male terminal housing 5, to alternately interleave the plural first joining terminals 4*a* to 4*c* therebetween to isolate between the first joining terminals 4*a* to 4*c*, respectively. When the male terminal housing 5 of the first connector portion 2 and the female terminal housing 7 of the second connector portion 3 are mated with each other, the plural first joining terminals 4*a* to 4*c* and the plural second joining terminals 6*a* to 6*c* face each other to form pairs, respectively (i.e. each pair of the first joining terminal 4*a* and the second joining terminal 6*a*, the first joining terminal 4*b* and the second joining terminal 6*b*, and the first joining terminal 4*c* and the second joining terminal 6*c*), at one surface thereof, and result in a stacked structure of the plural joining terminal pairs of plural facing first joining terminals 4*a* to 4*c* and second joining terminals 6*a* to 6*c* disposed alternately, and further alternately interleaved with the plural isolating members 8*a* to 8*d*.

This connector 1 is used for connection of a vehicle drive motor and an inverter for diving that motor, for example.

More specifically, the male terminal housing 5 of the first connector portion 2 (in FIG. 1, left side portion) is mated with a shield case of the motor, and the first joining terminal 4*a* to 4*c* portions exposed from the male terminal housing 5 are connected to terminals, respectively, of a terminal block installed in the shield case of the motor. Mating to this first connector portion 2 the second connector portion 3 electrically connected with the inverter results in electrical connection of the motor and the inverter. Although the foregoing is concerned with the motor side connection, the same applies to the inverter side connection.

First and Second Connector Portions 2 and 3

Below are described the respective specific structures of the first connector portion 2 and the second connector portion 3.

First Connector Portion 2

Figure 4A:
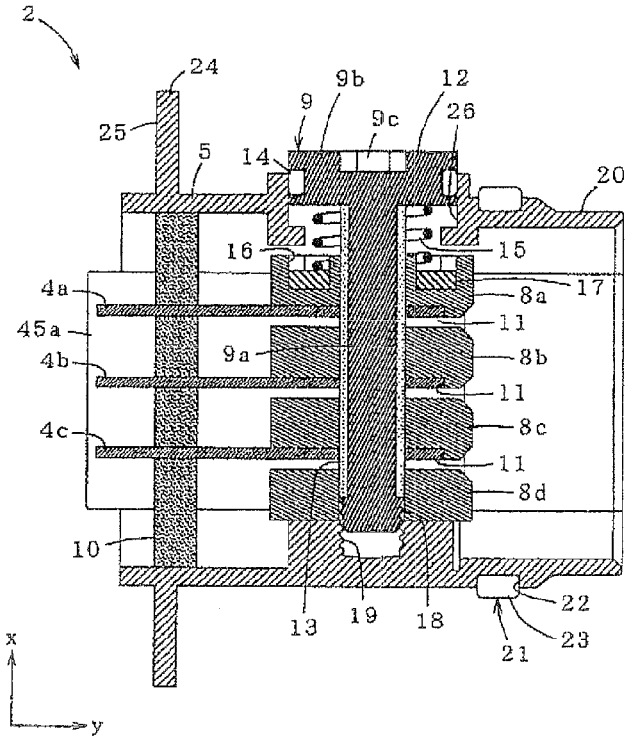
FIGS. 4A and 4B are a cross-sectional view along an x-y plane and a cross-sectional view along a y-z plane, respectively, showing the first connector portion.
Figure 4B:
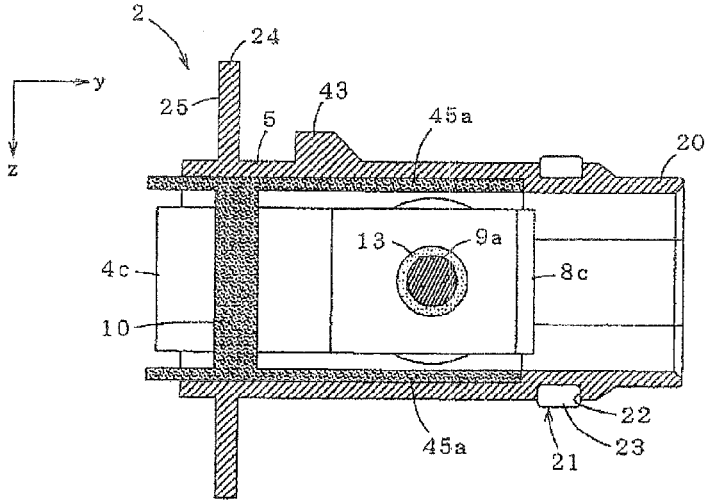

Referring to FIGS. 4A and 4B, the first connector portion 2 has the three first joining terminals 4*a* to 4*c* held therein to be aligned at a specified pitch, and includes the male terminal housing 5 for accommodating the three aligned first joining terminals 4*a* to 4*c*, the plural substantially rectangular parallelepiped isolating members 8*a* to 8*d* provided in the male terminal housing 5 for isolating each of the first joining terminals 4*a* to 4*c*, and a connecting member 9 with a head 9*b* and a shaft 9*a* connected to the head 9*b*, whose shaft 9*a* penetrates each contact between the plural first joining terminals 4*a* to 4*c* and the plural second joining terminals 6*a* to 6*c* and the plural isolating members 8*a* to 8*d*, and whose head 9*b* is pressed against the adjacent isolating member 8*a*, to thereby collectively fix the plural first joining terminals 4*a* to 4*c* and the plural second joining terminals 6*a* to 6*c* at the contacts therebetween, for electrical connections between the plural first joining terminals 4*a* to 4*c* and the plural second joining terminals 6*a* to 6*c*, respectively. At least a portion of the connecting member 9, which penetrates each contact, is formed of a non-conductive material.

First Joining Terminals 4*a* to 4*c*

The first joining terminals 4*a* to 4*c* are plate terminals, and are held to be aligned at a specified pitch by being spaced apart from each other by a first inner housing 10 formed of a non-conductive resin (e.g. PPS (polyphenylene sulfide) resin, PPA (polyphthalamide) resin, PA (polyimide) resin, PBT (polybutylene terephthalate), epoxy based resin), which forms a portion of the male terminal housing 5. As a method for holding the first joining terminals 4*a* to 4*c* with the first inner housing 10, there is a holding method by inserting the first joining terminals 4*a* to 4*c* during molding of the first inner housing 10 and then curing the resin, or a holding method by pressing the first joining terminals 4*a* to 4*c* into the first inner housing 10 which has been molded beforehand.

Also, the first joining terminals 4*a* to 4*c* are fixed integrally with the isolating members 8*a* to 8*c* disposed adjacent to their other surfaces (i.e. to the opposite surfaces to the surfaces joined with the second joining terminals 6*a* to 6*c*) respectively. That is, as described above, the first joining terminals 4*a* to 4*c* are held to be aligned at a specified pitch in the first inner housing 10, and fixed integrally with the isolating members 8*a* to 8*c* at tips respectively thereof, therefore resulting in the isolating members 8*a* to 8*c* being also aligned at a specified pitch. This configuration allows the insulating property between the respective contacts of the first joining terminals 4*a* to 4*c* and the second joining terminals 6*a* to 6*c*, and the insertability of the mating second joining terminals 6*a* to 6*c*, to be ensured.

The first joining terminals 4*a* to 4*c* are supplied with electricity at different voltages and/or currents, respectively. For example, in this embodiment, power lines are assumed to be for three phase alternating current between a motor and an inverter, so that the first joining terminals 4*a* to 4*c* are supplied with alternating currents, respectively, which are 120 degrees out of phase with each other. For the purpose of reducing the loss of power transmitted through the connector 1, the first joining terminals 4*a* to 4*c* may each be formed of a metal such as a high conductivity silver, copper, aluminum, or the like. Also, the first joining terminals 4*a* to 4*c* each have slight flexibility.

Isolating Members 8*a* to 8*d*

The plural isolating members 8*a* to 8*d* comprise the plurality of first isolating members 8*a* to 8*c* aligned and accommodated in the male terminal housing 5, and integrally fixed to one side of the plural first joining terminals 4*a* to 4*c*, respectively, (i.e. to the opposite side to the side joined with the second joining terminals 6*a* to 6*c*), and the second isolating member 8*d* provided to be integrally fixed to an inner surface of the male terminal housing 5, and to face one side of the second joining terminal 6*c* (i.e. the opposite side to the side joined with the first joining terminal 4*c*) positioned at the outermost side when stacking the plural first joining terminals 4*a* to 4*c* and the plural second joining terminals 6*a* to 6*c*.

Figure 5A:
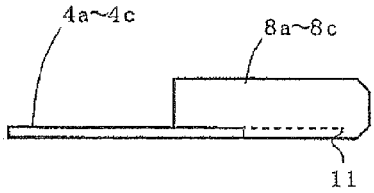
FIGS. 5A and 5B are a side view and a bottom view, respectively, showing a first joining terminal.
Figure 5B:
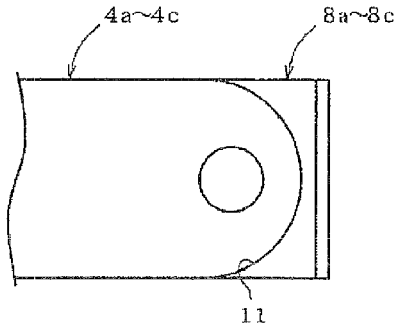

The plural isolating members 8*a* to 8*d* are fixed at such a position as to protrude from the tips of the first joining terminals 4*a* to 4*c*. Each of these isolating members 8*a* to 8*d* is chamfered at each of its corners on the second joining terminal 6*a* to 6*c* inserting/removing side. Also, referring to FIGS. 5A and 5B, each of the plural first isolating members 8*a* to 8*c* is formed with a protruding portion (thickened surface) 11 of its surface fixed to the first joining terminals 4*a* to 4*c* to fill the level difference therebetween, so that the lower surfaces (in the figure, the lower sides) of the plural first isolating members 8*a* to 8*c* are coplanar with the lower surfaces (in the figure, the lower sides) of the first joining terminals 4*a* to 4*c*, respectively. With this configuration, when the first connector portion 2 and the second connector portion 3 are mated with each other, the tips of the first joining terminals 4*a* to 4*c* do not contact the inserted tips of the second joining terminal 6*a* to 6*c*. The insertability of the second joining terminal 6*a* to 6*c* is therefore enhanced. In FIG. 5A, the structure of the first isolating member 8*a* is depicted as being simplified, and the first isolating members 8*a* to 8*c* are depicted likewise.

Connecting Member 9

Referring again to FIGS. 4A and 4B, the connecting member 9 has the shaft 9*a*, which penetrates the plural joining terminal pairs of plural facing first joining terminals 4*a* to 4*c* and second joining terminals 6*a* to 6*c* and the plural isolating members 8*a* to 8*d*, and at least whose surface to be in contact with the plural joining terminal pairs is formed to be non-conductive, and the head 9*b* formed integrally with the shaft 9*a*, which serves as a pressing portion.

More specifically, the connecting member 9 comprises a bolt (cap bolt) 12 made of a metal (e.g. SUS, iron, copper alloy, or the like) and an insulating layer 13 formed of a non-conductive resin material (e.g. PPS (polyphenylene sulfide) resin, PPA (polyphthalamide) resin, PA (polyamide) resin, PBT (polybutylene terephthalate), epoxy based resin), which coats the perimeter of the shaft 9*a* of that bolt 12. The head 9*b* of the bolt 12 is formed with an engaging hole 9*c*, such as a hexagonal hole, so that the bolt 12 may be rotated and tightened by engaging a tightening tool, such as a spanner, into that engaging hole 9*c*.

The entire connecting member 9 formed of a non-conductive resin may be used, but the connecting member 9 coated with the insulating layer 13 around the perimeter of the shaft 9*a* of the metallic bolt 12 is preferable from the point of view of strength. That is, the connecting member 9 having the combined structure of the metallic bolt 12 and the insulating layer 13 made of a non-conductive resin can have enhanced strength, compared to the entire connecting member 9 formed of a non-conductive resin. As the non-conductive resin for coating the metallic bolt 12, it is preferred to use a non-conductive resin, which has a linear expansion coefficient approximate to a linear expansion coefficient of a metal forming the bolt 12, to prevent creep.

The head 9*b* of the connecting member 9 is provided with a packing 14 therearound for preventing water from penetrating into the male terminal housing 5. Also, between the lower surface of the head 9*b* of the connecting member 9 and the upper surface of the first isolating member 8*a* directly therebelow is provided an elastic member 15 for applying a specified pressing force to the first isolating member 8*a*. The elastic member 15 is a spring made of a metal (e.g. SUS, or the like). In this embodiment, the elastic member 15 comprises a portion of the connecting member 9.

An upper surface of the first isolating member 8*a* to be in contact with a lower portion of the elastic member 15, i.e., in the side to be in contact with the elastic member 15 of the first isolating member 8*a* adjacent to the head 9*b*, is formed with a recessed portion 16 which covers (accommodates) a lower portion at one end of the elastic member 15. The bottom of the recessed portion 16 (i.e. the base to be in contact with the lower portion of the elastic member 15) is provided with a receiving member 17 made of a metal (e.g. SUS, or the like) which receives the elastic member 15 and which is for preventing damage to the first isolating member 8*a* formed of a non-conductive resin.

The receiving member 17 prevents damage to the first isolating member 8*a* by dispersing stress applied to the upper surface of the first isolating member 8*a* from the elastic member 15. It is therefore preferred to make the contact area between the receiving member 17 and the first isolating member 8*a* as large as possible. In this embodiment, to make the contact area between the receiving member 17 and the first isolating member 8*a* large, the receiving member 17 shaped in a manner that contacts the entire surface of the bottom of the recessed portion 16 is provided.

This connecting member 9 is inserted into the male terminal housing 5 from above the first joining terminal 4*a* to 4*c* surfaces (in FIG. 4A, the upper surfaces) to which are fixed the first isolating members 8*a* to 8*c*, respectively. A screwing portion 18 at a tip of the shaft 9*a* is then screwed into a screw hole 19 formed in an inner surface of the male terminal housing 5, to thereby allow the connecting member 9 to press the plural first joining terminals 4*a* to 4*c* and the plural second joining terminals 6*a* to 6*c* from its head 9*b* toward the tip of its shaft 9*a* (in FIG. 4A, downward from above), and collectively fix the plural first joining terminals 4*a* to 4*c* and the plural second joining terminals 6*a* to 6*c* at the contacts therebetween, for electrical connections between the plural first joining terminals 4*a* to 4*c* and the plural second joining terminals 6*a* to 6*c*, respectively.

Male Terminal Housing 5

The male terminal housing 5 is formed of a cylindrical hollow body 20 which is substantially rectangular in transverse cross section. An outer portion at one end (in the figure, at the right end) of the cylindrical body 20 mated with the female terminal housing 7 is formed in a tapered shape, taking the mateability with the second connector portion 3 into consideration. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (in the figure, in the left end) of the cylindrical body 20 is accommodated the first inner housing 10 with the first joining terminals 4*a* to 4*c* aligned and held therewith. In an outer portion at the other end of the cylindrical body 20 is formed a flange 24 (an attachment hole omitted) for fixing the first connector portion 2 to a device chassis (e.g. a motor shield case). At a rim 25 of the flange 24 having the attachment hole for bolt insertion and fixation to a device chassis may be provided a packing for sealing between the first connector portion 2 and the device chassis. The structure of this flange 24 is not assumed as fixing the first connector portion 2 to a device chassis, but the flange 24 may be provided in the second connector portion 3, or in both the first connector portion 2 and the second connector portion 3. Also, both of the first connector portion 2 and the second connector portion 3 may be free or not fixed to a device chassis.

Also, this flange 24 is effective in enhancing the dissipation of heat. That is, the formation of the flange 24 permits a large surface area of the male terminal housing 5, thereby allowing enhancement in the dissipation to outside via the male terminal housing 5, of heat produced inside the first connector portion 2 (e.g. heat produced at each contact).

In an upper portion (in the figure, in the upper side) of the cylindrical body 20 is formed a connecting member insertion hole 26 for inserting the connecting member 9. The connecting member insertion hole 26 is formed in a cylindrical shape, and bent inward at a lower end (in the figure, at the lower side) of that cylindrical shape. A rim of the lower surface of the head 9*b* of the connecting member 9 is contacted with this bent portion of the connecting member insertion hole 26, to thereby regulate the stroke of the connecting member 9.

Also, as shown in FIG. 4B, the exterior of the cylindrical body 20 is formed with a protruding portion 43. The protruding portion 43 is engaged into an engaging portion 44 formed in the female terminal housing 7, as described later, to fix and maintain the mating of the male terminal housing 5 and the female terminal housing 7.

For shielding performance, heat dissipation, and weight reduction of the connector 1, the cylindrical body 20 is formed of a high electrical conductivity, high thermal conductivity and lightweight metal such as an aluminum. The cylindrical body 20 formed of an aluminum as mentioned above allows the connecting member 9 to be firmly tightened into the screw hole 19 when screwed thereinto, compared with the cylindrical body 20 formed of a material other than metal (e.g. insulating resin).

Also, the cylindrical body 20 constituting the male terminal housing 5 is metallic. It is therefore necessary to prevent the respective contacts between the first joining terminals 4*a* to 4*c* and the second joining terminals 6*a* to 6*c* from short circuiting with each other through the male terminal housing 5.

For example, when 100 A current flows through each contact, in order to achieve the insulation between each contact and the male terminal housing 5, it is necessary to ensure that both the spatial distance and creeping distance between each contact and the male terminal housing 5 are not less than 6 mm.

That is, in the connector 1 in this embodiment, since the plural joining terminal pairs of plural facing first joining terminals 4*a* to 4*c* and second joining terminals 6*a* to 6*c* disposed alternately to constitute the stacked structure are isolated from each other in the stacking direction by the plural isolating members 8*a* to 8*c*, the spatial distance and creeping distance being not less than 6 mm may be ensured between the side surface of the stacked structure and the male terminal housing 5.

To this end, the clearance being not less than 6 mm may be provided between the side surface of the stacked structure and the male terminal housing 5, but there is the problem that the size of the connector is increased by that clearance.

Electricity Screening Plate 45 (First and Second Electricity Screening Plates 45*a* and 45*b*)

Accordingly, to make the clearance as small as possible while being able to ensure that both the spatial distance and creeping distance between the side surface of the stacked structure and the male terminal housing 5 are not less than 6 mm, the inventors provide an electricity screening (or electric insulating) plate 45 (see FIG. 9) disposed between the stacked structure and the male terminal housing 5 to cover the side surface of the stacked structure facing the male terminal housing 5, more specifically, at least all of the respective plural contacts between the first joining terminals 4*a* to 4*c* and the second joining terminals 6*a* to 6*c* at the sides of the stacked structure.

The electricity screening (or electric insulating) plate 45 comprises a first electricity screening plate 45*a* provided within the male terminal housing 5, and a second electricity screening plate 45*b* provided within the female terminal housing 7. The electricity screening plate 45 is configured so that the first and second electricity screening plates 45*a* and 45*b* are overlapped at a specified wrap length L, as described in detail later, when the male terminal housing 5 and the female terminal housing 7 are mated with each other.

As shown in FIG. 4B, the first electricity screening plate 45*a* is molded integrally with the first inner housing 10 at both sides (in FIG. 4B, upper and lower sides) of the first inner housing 10 aligning and holding the first joining terminals 4*a* to 4*c*, and is fixed integrally with and along the inner surface of the male terminal housing 5 facing the stacked structure. The integral fixing of the first electricity screening plate 45*a* to and along the inner surface of the male terminal housing 5 allows the second joining terminals 6*a* to 6*c* to be prevented from colliding with and breaking the end of the first electricity screening plate 45*a*, when the male terminal housing 5 and the female terminal housing 7 are mated with each other.

Second Connector Portion 3

Figure 6A:
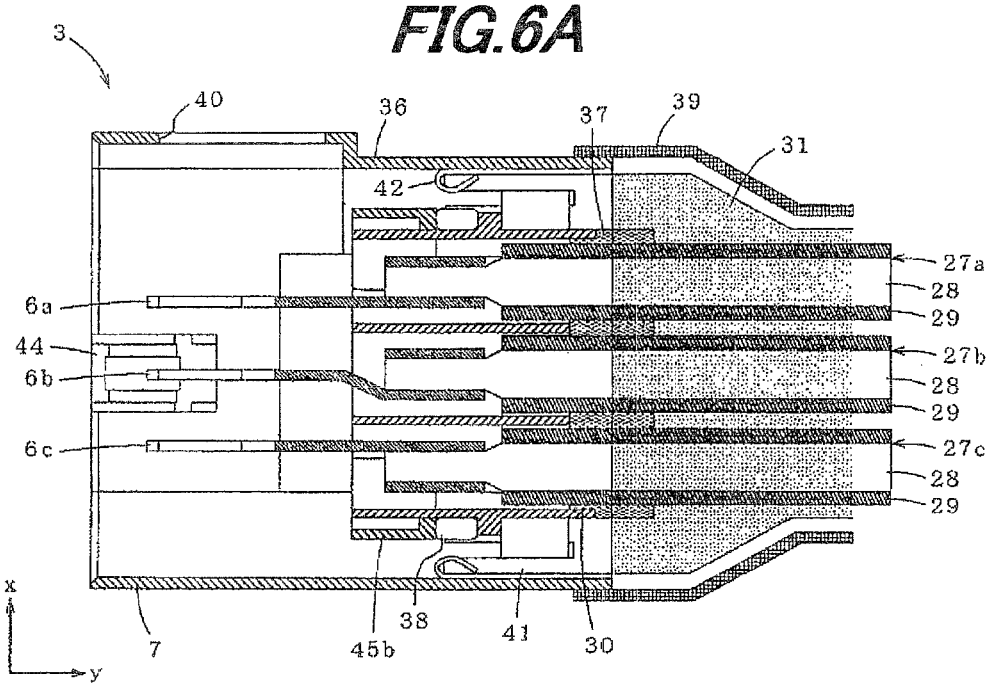
FIGS. 6A and 6B are a cross-sectional view along an x-y plane and a cross-sectional view along a y-z plane, respectively, showing the second connector portion.
Figure 6B:
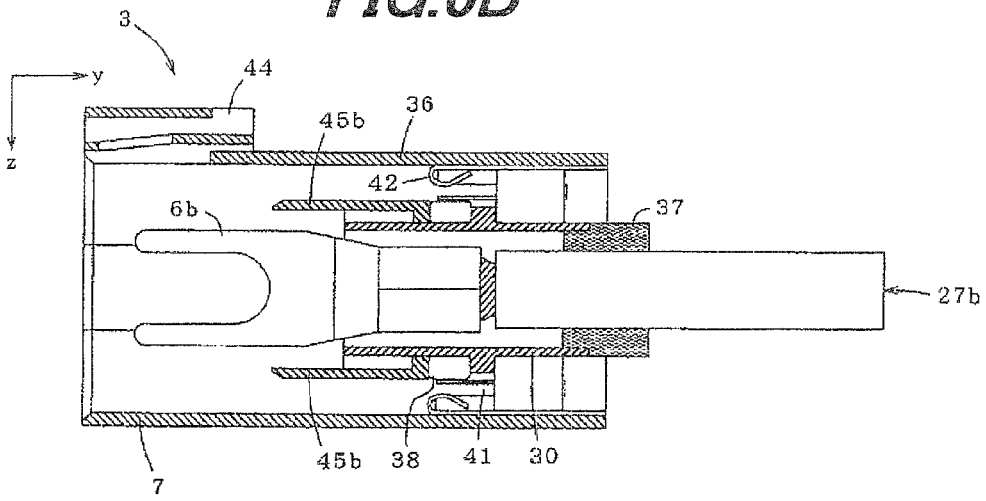

Referring to FIGS. 6A and 6B, the second connector portion 3 has the female terminal housing 7 with a plurality of (three) second joining terminals (female terminals) 6*a* to 6*c* aligned and accommodated therein.

The second joining terminals 6*a* to 6*c* are connected with cables 27*a* to 27*c*, respectively, at one end, which extend from an inverter. These cables 27*a* to 27*c* are electrically connected to the first joining terminals 4*a* to 4*c* via the second joining terminals 6*a* to 6*c*, respectively, and therefore supplied with electricity at voltages and/or currents in correspondence to the second joining terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held to be aligned at a specified pitch by a multi-cylindrical second inner housing 30. With this second inner housing 30, when the first connector portion 2 and the second connector portion 3 are mated with each other, the second joining terminals 6*a* to 6*c* are held to be positioned below the first joining terminals 4*a* to 4*c* to face (i.e. to be connected to) the second joining terminals 6*a* to 6*c* to form pairs respectively.

The second inner housing 30 is formed of a non-conductive resin, to isolate the second joining terminals 6*a* to 6*c* from each other to prevent a short circuit. This second inner housing 30 allows the second joining terminals 6*a* to 6*c* to be held at specified positions respectively, even when the cables 27*a* to 27*c* respectively connected to the second joining terminals 6*a* to 6*c* have excellent flexibility. That is, in this embodiment, the cables 27*a* to 27*c* to be used can have excellent flexibility, and therefore enhance a degree of freedom of wiring the cables 27*a* to 27*c*.

Although the second joining terminals 6*a* to 6*c* are positioned by the second inner housing 30 holding the cables 27*a* to 27*c*, more specifically, the ends near the second joining terminals 6*a* to 6*c* of the cables 27*a* to 27*c* to hold the second joining terminals 6*a* to 6*c* at specified positions respectively, the second joining terminals 6*a* to 6*c* may be positioned by the second inner housing 30 holding the cables 27*a* to 27*c*, and the second joining terminals 6*a* to 6*c* directly. Also, the second inner housing 30 may be configured to hold not the cables 27*a* to 27*c*, but the second joining terminals 6*a* to 6*c* directly.

In the case that, with the second inner housing 30, the second joining terminals 6*a* to 6*c* are positioned by holding the cables 27*a* to 27*c* without directly holding the second joining terminals 6*a* to 6*c*, that is, in the case of this embodiment, making the cables 27*a* to 27*c* flexible allows the tips of the second joining terminals 6*a* to 6*c* to have flexibility relative to the female terminal housing 7. This construction permits flexible adaptation, even to deformation of first joining terminal 4*a* to 4*c* portions to insert the second joining terminals 6*a* to 6*c* in the first connector portion 2, when pressed by the connecting member 9.

The second inner housing 30 is provided with the second electricity screening plate 45*b*, which overlaps the first electricity screening plate 45*a* at the specified wrap length L, when the male terminal housing 5 and the female terminal housing 7 are mated with each other. In this case, the first and second electricity screening plates 45*a* and 45*b* may be or be not contacted with each other.

There may be no second electricity screening plate 45*b*, provided that each contact can be isolated from the male terminal housing 5 by only the first electricity screening plate 45*a*. In this embodiment, even though the first electricity screening plate 45*a* is provided to extend to the tip in the mating direction of the male terminal housing 5, the respective ends of the cables 27*a* to 27*c* cannot be covered with only the first electricity screening plate 45*a*. There is therefore provided the second electricity screening plate 45*b*.

Also, a braided shield 31 is wrapped around cables 27*a* to 27*c* portions drawn out of the female terminal housing 7, for the purpose of enhancement in shielding performance. This braided shield 31 is contacted with a later-described cylindrical shield body 41, and electrically connected to the male terminal housing 5 (an equipotential (GND)) through the cylindrical shield body 41. For simplicity, no braided shield 31 is shown in FIGS. 1, 2, 6B and 9.

Second Joining Terminals 6*a* to 6*c*

Figure 7A:
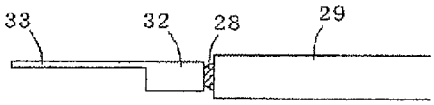
FIGS. 7A and 7B are a side view and a bottom view, respectively, showing a second joining terminal.
Figure 7B:
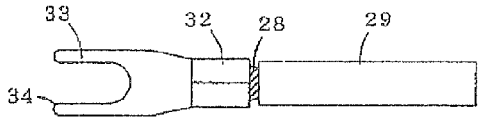
Figure 8A:
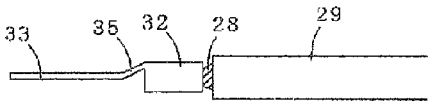
FIGS. 8A and 8B are a side view and a bottom view, respectively, showing a second joining terminal.
Figure 8B:
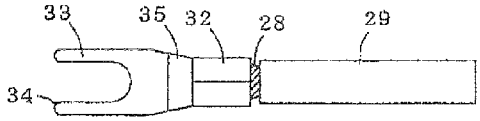

Referring to FIGS. 7 and 8, the second joining terminals 6*a* to 6*c* respectively include caulking portions 32 for caulking the conductors 28 exposed from the tips of the cables 27*a* to 27*c*, and U-shaped contacts 33 formed integrally with the caulking portions 32. At tips of the U-shaped contacts 33 are respectively formed tapered portions 34 to enhance the insertability of the U-shaped contacts 33. When the first connector portion 2 and the second connector portion 3 are mated with each other, the U-shaped contacts 33 are inserted in such a manner as to grip the shaft 9*a* of the connecting member 9.

In this embodiment, to reduce the size of the connector 1, the cables 27*a* to 27*c* are configured to be aligned and held as close to each other as possible. To this end, as shown in FIG. 8, a trunk 35 of the second joining terminal 6*b* to be connected to the cable 27*b* arranged in the middle when aligned is bent, to thereby space the second joining terminals 6*a* to 6*c* apart at the same pitch.

The second joining terminals 6*a* to 6*c* may each be constructed of a high electrical conductivity metal such as silver, copper, aluminum, or the like, in order to reduce the loss of power transmitted through the connector 1. Also, the second joining terminals 6*a* to 6*c* each have slight flexibility.

Female Terminal Housing 7

Referring again to FIGS. 6A and 6B, the female terminal housing 7 is formed of a cylindrical hollow body 36 which is substantially rectangular in transverse cross section. To mate the male terminal housing 5 into the female terminal housing 7, an inner portion at one end (in the figure, at the left end) of the cylindrical body 36 mated with the male terminal housing 5 is formed in a tapered shape, taking the mateability with the male terminal housing 5 into consideration.

In the other end (in the figure, in the right end) of the cylindrical body 36 is accommodated the second inner housing 30 with the cables 27*a* to 27*c* aligned and held therewith. On a cable insertion side of the second inner housing 30 is formed a packingless sealing portion 37, to prevent water from penetrating onto the cables 27*a* to 27*c* and into the female terminal housing 7. In an outer portion of the second inner housing 30 is provided a packing 38 to be in contact with an inner surface of the male terminal housing 5. That is, the connector 1 has a double waterproofing structure of the packing 23 of the terminal housing waterproofing structure 21 and the packing 38 provided in the outer portion of the second inner housing 30.

Further, the other end of the cylindrical body 36 from which the cables 27*a* to 27*c* are drawn out is covered with a rubber boot 39 for preventing water from penetrating into the cylindrical body 36. For simplification, no rubber boot 39 is shown in FIGS. 1, 2, 6B and 9.

Also, in an upper portion (in the figure, in the upper side) of the cylindrical body 36 is formed a connecting member manipulation hole 40 for manipulating the connecting member 9 provided in the first connector portion 2 when the first connector portion 2 and the second connector portion 3 are mated with each other. This connecting member manipulation hole 40 also serves as a through hole to permit the connecting member 9 to be inserted into or removed out of the male terminal housing 5, after the male terminal housing 5 and the female terminal housing 7 are mated with each other. This connecting member manipulation hole 40 serving as the through hole allows facilitation of connector 1 assembling.

Further, as shown in FIG. 6B, the exterior of the cylindrical body 36 is formed with an engaging portion 44, into which the protruding portion 43 of the male terminal housing 5 is engaged, when the male terminal housing 5 and the female terminal housing 7 are mated with each other.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of a non-conductive resin. Therefore, to enhance its shielding performance and heat dissipation, the cylindrical shield body 41 made of an aluminum is provided on an inner surface at the other end of the cylindrical body 36.

The cylindrical shield body 41 has a contact 42 to be contacted with an outer portion of the male terminal housing 5 made of a metal when the first connector portion 2 and the second connector portion 3 are mated with each other. The cylindrical shield body 41 is thermally and electrically connected with the male terminal housing 5 via this contact 42. This enhances the shielding performance and the heat dissipation. In particular, the heat dissipation is likely to be significantly enhanced by positively allowing heat to escape toward the male terminal housing 5 having an excellent heat dissipation property.

Connection Between the First Joining Terminals 4*a* to 4*c* and the Second Joining Terminals 6*a* to 6*c*

Next is described the connection between the first joining terminals 4*a* to 4*c* and the second joining terminals 6*a* to 6*c* using the connector 1 in this embodiment.

When the first connector portion 2 and the second connector portion 3 are mated with each other, the second joining terminals 6*a* to 6*c* are inserted between the first joining terminal 4*a* with the isolating member 8*a* and the isolating member 8*b*, between the first joining terminal 4*b* with the isolating member 8*b* and the isolating member 8*c*, and between the first joining terminal 4*c* with the isolating member 8*c* and the isolating member 8*d*, respectively, where the first joining terminals 4*a* to 4*c* and the second joining terminals 6*a* to 6*c* form pairs respectively. That insertion then allows the plural first joining terminals 4*a* to 4*c* and the plural second joining terminals 6*a* to 6*c* to face each other to form pairs, respectively, and result in a stacked structure of the plural joining terminal pairs of plural facing first joining terminals 4*a*, 4*b*, and 4*c* and second joining terminals 6*a*, 6*b*, and 6*c* disposed alternately, and further alternately interleaved with the plural isolating members 8*a* to 8*d*.

In this case, inside the first connector portion 2, the isolating members 8*a* to 8*c* are respectively fixed to the tips of the first joining terminals 4*a* to 4*c* held to be aligned at a specified pitch. A pitch between the isolating members 8*a*, 8*b* and 8*c* can therefore be held, even without separately providing a holding jig for holding the pitch between the isolating members 8*a*, 8*b* and 8*c*. This allows the second joining terminals 6*a* to 6*c* to be easily inserted between the first joining terminal 4*a* with the isolating member 8*a* and the isolating member 8*b*, between the first joining terminal 4*b* with the isolating member 8*b* and the isolating member 8*c*, and between the first joining terminal 4*c* with the isolating member 8*c* and the isolating member 8*d*, respectively, where the first joining terminals 4*a* to 4*c* and the second joining terminals 6*a* to 6*c* form the pairs respectively. That is, the insertability/removability of the second joining terminals 6*a* to 6*c* is unlikely to deteriorate. Also, because of no need to provide a holding jig for holding the pitch between the isolating members 8*a*, 8*b* and 8*c*, further size reduction can very effectively be achieved, compared to the prior art.

Also, the contact between the first joining terminal 4*a* (or 4*b*) and the second joining terminal 6*a* (or 6*b*) is sandwiched between the first isolating member 8*a* (or 8*b*) fixed to the first joining terminal 4*a* (or 4*b*) constituting the contact, and the first isolating member 8*b* (or 8*c*) fixed to the first joining terminal 4*b* (or 4*c*) constituting the other contact. Likewise, the contact between the first joining terminal 4*c* and the second joining terminal 6*c* is sandwiched between the first isolating member 8*c* fixed to the first joining terminal 4*c* constituting the contact, and the second isolating member 8*d* fixed to the inner surface of the male terminal housing 5.

Referring to FIG. 3, following that, the connecting member 9 is manipulated from the connecting member manipulation hole 40, to screw and tighten the screwing portion 18 of the connecting member 9 into the screw hole 19 of the male terminal housing 5. The connecting member 9 is then rotated and pressed into the bottom of the screw hole 19, and causes the elastic member 15 to, in turn, press the first isolating member 8*a*, the first isolating member 8*b*, the first isolating member 8*c*, and the second isolating member 8*d*, and sandwich the contacts between the isolating members 8*a* and 8*b*, between the isolating members 8*b* and 8*c*, and between the isolating members 8*c* and 8*d*, respectively, with the contacts isolated from each other. In this case, by being pressed by the isolating members 8*c* and 8*d*, the first joining terminals 4*a* to 4*c* and the second joining terminals 6*a* to 6*c* are slightly bent and contacted with each other, respectively, in a wide range. This allows the realization of the connector being especially effective on vehicle which tends to cause vibration.

Figure 9:
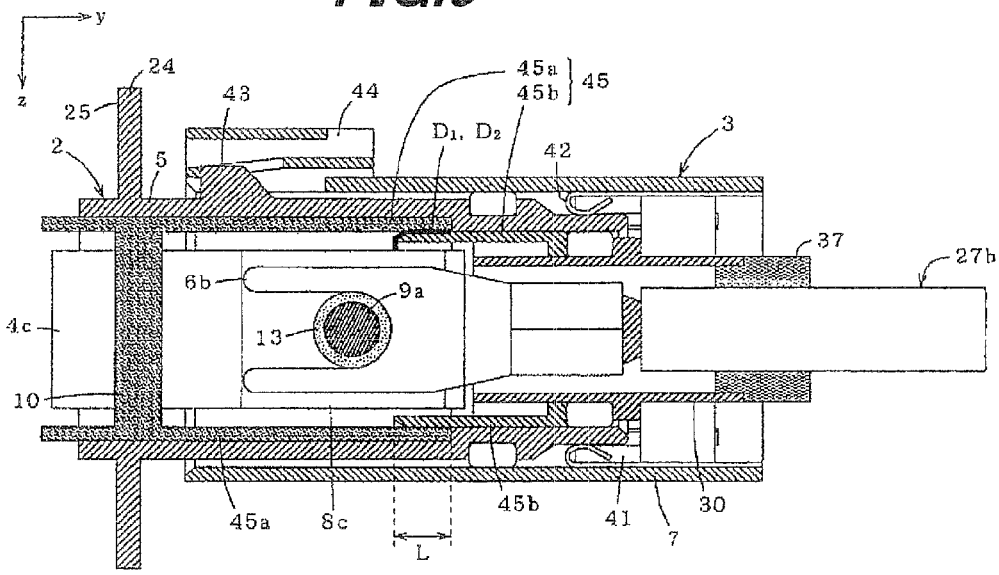
FIG. 9 is a cross-sectional view along a y-z plane showing the connector after mating the first connector portion and the second connector portion.

Further, as shown in FIG. 9, since the connector 1 in this embodiment is provided with the electricity screening plate 45 comprising the first and second electricity screening plates 45*a* and 45*b* overlapped at the specified wrap length L when the male terminal housing 5 and the female terminal housing 7 are mated with each other, the spatial distance $D_1$ and the creeping distance $D_2$ between each contact and the male terminal housing 5 are indicated by bold line as shown. That is, the spatial distance $D_1$ and the creeping distance $D_2$ between each contact and the male terminal housing 5 being not less than 6 mm can be ensured, even if the clearance therebetween is less than 6 mm.

In short, since the connector 1 in this embodiment is provided with the electricity screening plate 45 disposed between the stacked structure and the male terminal housing 5 to cover the side surface of the stacked structure facing the male terminal housing 5, even if the clearance provided between each contact of the stacked structure and the male terminal housing 5 is not great, the stable insulation can be ensured and further size reduction can be achieved, compared to the prior art.

The invention is not limited to the above embodiment, but various alterations may be made without departing from the spirit and scope of the invention.

For example, although in this embodiment, three phase alternating power lines have been assumed, according to the technical idea of the invention, the connector for a vehicle, for example, may be configured to collectively connect lines for different uses, such as three phase alternating current power lines for between a motor and an inverter, two phase direct current power lines for an air conditioner, and the like. This configuration allows power lines for a plurality of uses to be collectively connected by one connector. There is therefore no need to prepare a different connector for each use, to thereby allow a contribution to space saving or low cost.

Also, although in this embodiment, the first joining terminals 4*a* to 4*c* and the second joining terminals 6*a* to 6*c* are in surface contact with each other respectively, the first joining terminal 4*a* to 4*c* contact side surfaces to be contacted with the second joining terminals 6*a* to 6*c* may be formed with protruding portions, and the U-shaped contacts 33 of the second joining terminals 6*a* to 6*c* may be configured to be fitted onto these protruding portions, respectively. This configuration allows the further stabilization of the coupling force of the first joining terminals 4*a* to 4*c* and the second joining terminals 6*a* to 6*c*, respectively. That is, this configuration is especially effective for vibration perpendicular to the connecting member 9.

Also, the terminal surfaces of the first joining terminals 4*a* to 4*c* and the second joining terminals 6*a* to 6*c* may be knurled to make their frictional force large, so that the terminals are thereby unlikely to move relative to each other, and are firmly fixed at the contacts therebetween respectively.

Also, although in this embodiment, the lengths of the branch tips of each U-shaped contact 33 of the second joining terminals 6*a* to 6*c* are the same, one length thereof may be formed to be long to form a J-shaped contact. The J-shaped contact allows the second connector portion 3 to be inserted into the shaft 9*a* of the connecting member 9 obliquely relative to the cable longitudinal direction.

Also, although in this embodiment, when viewed from the head 9*b* of the connecting member 9, the first joining terminals 4*a* to 4*c* and the second joining terminals 6*a* to 6*c* have been configured to be linearly contacted with each other respectively, the male terminal housing 5 and the female terminal housing 7 may be configured so that, when viewed from the head 9*b* of the connecting member 9, the first joining terminals 4*a* to 4*c* of the first connector portion 2 cross and contact the second joining terminals 6*a* to 6*c* of the second connector portion 3 respectively at a right angle thereto. That is, the first connector portion 2 and the second connector portion 3 may be mated with each other in an L-shape. Likewise, the female terminal housing 7 and the second joining terminals 6*a* to 6*c* may be configured to be disposed obliquely relative to the male terminal housing 5 and the first joining terminals 4*a* to 4*c* respectively. By thus applying the gist of the invention, the direction of inserting/removing the second connector portion 3 relative to the first connector portion 2 may be varied. That is, the direction of drawing the cables out from the connector can be fitted to a desired direction, to thereby allow a contribution to space saving.

Also, although in this embodiment it has been described that, unlike the second joining terminals 6*a* to 6*c*, the first joining terminals 4*a* to 4*c* are not connected with cables respectively, the first joining terminals 4*a* to 4*c* are not limited to this structure.

Also, although in this embodiment, the cables 27*a* to 27*c* used have excellent flexibility, rigid cables may be used.

Also, although in this embodiment, the screw hole 19 is formed in the male terminal housing 5, only a through hole, not the screw hole 19 may be formed in the male terminal housing 5, and the screw hole 19 may be formed in the female terminal housing 7. Also, the screw hole 19 may be formed both in the male terminal housing 5 and the female terminal housing 7.

Further, although in this embodiment, the screw hole 19 is formed at such a position as to be screwed onto the screwing portion 18 at the tip of the connecting member 9, the screwing portion 18 may be formed in the head 9*b* of the connecting member 9, and the screw hole 19 may be formed to be screwed onto the screwing portion 18 formed in the head 9*b*.

Also, although in this embodiment, the bolt 12 has been described as the example of the connecting member 9, the connecting member 9 construction is not intended to be limited to bolt shape, but the connecting member 9 may, for example, be configured as a shaft of a CPA (connector position assurance) lever for fixing the mating of the first connector portion 2 and the second connector portion 3, to turn the CPA lever to fix the mating thereof, and press (or tighten) the connecting member 9 from the head 9*b* toward the tip of the shaft 9*a* of the connecting member 9.

Also, although in this embodiment, the upper surface of the head 9*b* of the bolt 12 used as the connecting member 9 has been assumed as being formed with the engaging hole 9*c*, into which is engaged a commercial hexagonal wrench (also called hexagonal spanner), the upper surface of the head 9*b* of the bolt 12 used as the connecting member 9 may be configured to be formed with a recessed portion shaped to fit onto an uncommercial exclusive tool shape assumed to be used.

Also, in this embodiment, the use orientation of the connector is such that the connecting member 9 may be substantially horizontal or substantially vertical. In other words, the use conditions of the connector in this embodiment require no use orientation.

Also, although in this embodiment, the head 9*b* of the connecting member 9 is pressed against the adjacent first isolating member 8*a* via the elastic member 15 comprising a portion of the connecting member 9, the head 9*b* may be pressed directly against the adjacent first isolating member 8*a*, not via the elastic member 15.

Also, although in this embodiment, the connecting member 9 has been described as the penetrating connecting member which allows the facilitation of the constant respective positional relationships of between the first joining terminals 4*a* to 4*c* and the second joining terminals 6*a* to 6*c* relative to the central connecting member 9 with the first connector portion 2 and the second connector portion 3 mated together, the spirit of the invention may be applied to even the non-penetrating connecting member.

Figure 10:
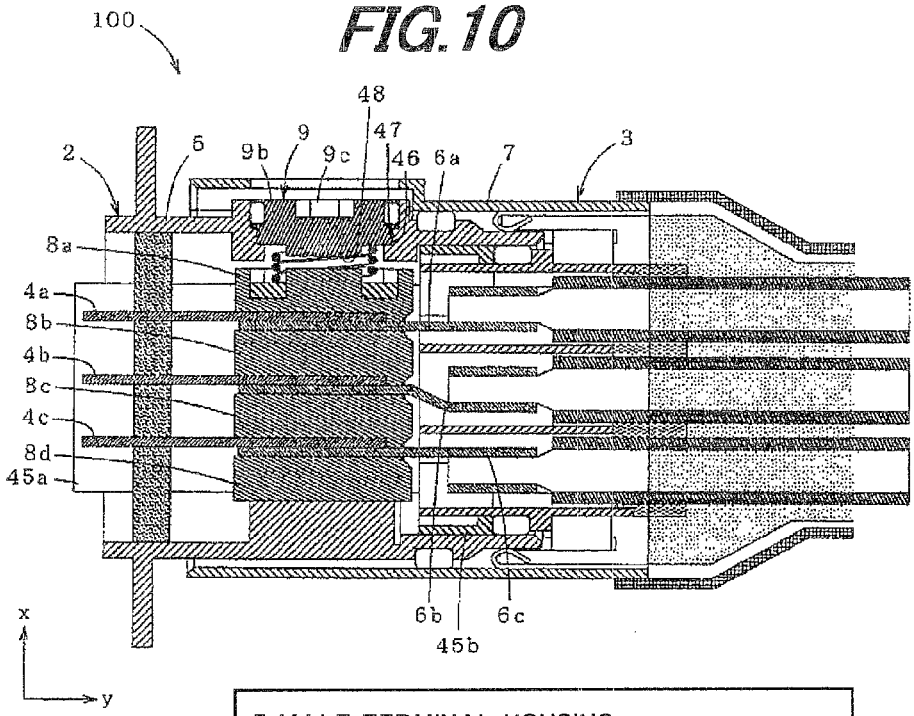
FIG. 10 is a cross-sectional view showing a connector after mating the first connector portion and the second connector portion, in a modified embodiment according to the invention.

That is, the spirit of the invention may be applied to even the connecting member 9 as shown in FIG. 10, configured to have only the head 9*b* without the shaft 9*a*, to cause the head 9*b* to press the adjacent first isolating member 8*a*, to thereby collectively fix the plural first joining terminals 4*a* to 4*c* and the plural second joining terminals 6*a* to 6*c* at the contacts therebetween, for electrical connections between the plural first joining terminals 4*a* to 4*c* and the plural second joining terminals 6*a* to 6*c*, respectively. With this configuration, the screwing of the male terminal housing 5 and the connecting member 9 can be accomplished by a screwing portion 46 formed in a side surface of the head 9*b* of the connecting member 9 and a screw hole 47 formed in the male terminal housing 5 which is screwed onto that screwing portion 46. Also, in this case, as with the embodiment, there may be provided the elastic member 15 between the head 9*b* and the first isolating member 8*a* adjacent to that head 9*b*, i.e., on an elastic member holding portion 48 formed in a lower surface of the head 9*b*. This configuration results from fixing the plural isolating members 8*a* to 8*c* to the other surfaces of the plural first joining terminals 4*a* to 4*c* respectively, and can ensure the cost reduction of the connecting member 9. Also, this leads to the weight reduction of the connecting member 9, thus allowing a contribution to the weight reduction of the entire connector 1.

Also, although in this embodiment, one end of the first electricity screening plate 45*a* is configured to protrude from the male terminal housing 5 as shown in FIGS. 1 and 9 by forming one end of the first joining terminals 4*a* to 4*c* constituting the stacked structure to protrude from the male terminal housing 5, it is not necessary to cause the first electricity screening plate 45*a* to protrude from the male terminal housing 5 to be connected with a device, provided that that device is configured to cause no short circuit between the stacked structure and a shield case of that device, even if the first electricity screening plate 45*a* is not protruded.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A connector, comprising:

a metallic male terminal housing with a plurality of first joining terminals aligned and accommodated therein;

a female terminal housing with a plurality of second joining terminals aligned and accommodated therein;

a stacked structure that when the male terminal housing is mated into the female terminal housing, within the male terminal housing, the plural first joining terminals and the plural second joining terminals face each other to form pairs, respectively, at one surface thereof, and the first joining terminals and the second joining terminals are disposed alternately;

a plurality of isolating members disposed to alternately interleave the plural joining terminal pairs of plural first joining terminals and plural second joining terminals that are respectively facing to each other in a state that the male terminal housing is mated in the female terminal housing;

a connecting member for pressing the adjacent isolating members, to thereby collectively fix the plural first joining terminals and the plural second joining terminals at the contacts therebetween, for electrical connections between the plural first joining terminals and the plural second joining terminals, respectively; and an electricity screening plate disposed between the stacked structure and the male terminal housing to cover a side surface of the stacked structure facing the male terminal housing, for ensuring both a spatial distance and a creeping distance to the extent of achieving an insulation between the side surface of the stacked structure and the male terminal housing.

2. The connector according to claim 1, wherein the electricity screening plate is fixed integrally with and along an inner surface of the male terminal housing facing the stacked structure.

3. The connector according to claim 1, further comprising a first inner housing for aligning and holding the plural first joining terminals, wherein the electricity screening plate is molded integrally with that first inner housing.

4. The connector according to claim 1, wherein the electricity screening plate comprises a first electricity screening plate provided within the male terminal housing, and a second electricity screening plate provided within the female terminal housing, and the first electricity screening plate and the second electricity screening plate are overlapped at a specified wrap length, when the male terminal housing and the female terminal housing are mated with each other.

5. The connector according to claim 1, wherein the plurality of isolating members are aligned and accommodated in the male terminal housing, and are fixed to other surfaces of the plural first joining terminals respectively.

6. The connector according to claim 1, wherein the electricity screening plate is configured to be separated from the plurality of isolating members.

7. The connector according to claim 1, wherein the electricity screening plate is electrically insulating.

* * * * *